US005642986A

United States Patent [19]

Rose

[11] Patent Number: 5,642,986

[45] Date of Patent: Jul. 1, 1997

[54] FLEXIBLE IMPELLER WITH ONE-PIECE HUB

[75] Inventor: Mitchell Rose, South Euclid, Ohio

[73] Assignee: The Scott Fetzer Company, Westlake, Ohio

[21] Appl. No.: 623,331

[22] Filed: Mar. 27, 1996

Related U.S. Application Data

[63] Continuation-in-part of Ser. No. 495,362, Jun. 28, 1995.

[51] Int. Cl.[6] ..... F04D 29/38

[52] U.S. Cl. ..... 416/240; 416/220 A; 416/219 A

[58] Field of Search ..... 416/132 A, 132 R, 416/212 R, 213 A, 219 A, 220 A, 244 R, 240

[56] References Cited

U.S. PATENT DOCUMENTS

| | | | |
|---|---|---|---|
| 77,415 | 4/1868 | Tilman et al. | 416/501 |
| 1,042,431 | 10/1912 | Griggs . | |
| 1,053,321 | 2/1913 | Schrock . | |
| 1,426,954 | 8/1922 | Brooks . | |
| 1,868,113 | 7/1932 | Ljungstrom . | |
| 1,909,885 | 5/1933 | Ogden | 416/220 A |
| 2,237,451 | 4/1941 | Samuels . | |
| 2,466,440 | 4/1949 | Kiekhaefer . | |
| 2,636,479 | 4/1953 | Smyser . | |
| 2,669,188 | 2/1954 | McIntyre . | |
| 2,671,408 | 3/1954 | Kreitchman . | |
| 2,843,049 | 7/1958 | Sherwood . | |
| 2,892,646 | 6/1959 | Doble . | |
| 3,029,744 | 4/1962 | Goettl . | |
| 3,045,986 | 7/1962 | Fraunberger . | |
| 3,080,824 | 3/1963 | Boyd et al. . | |
| 3,202,343 | 8/1965 | Emmermann et al. . | |
| 3,303,791 | 2/1967 | Doble . | |
| 3,306,529 | 2/1967 | Nelson . | |
| 3,973,865 | 8/1976 | Mugele . | |
| 3,990,808 | 11/1976 | Isaacson . | |
| 4,172,693 | 10/1979 | Burton et al. . | |
| 4,422,822 | 12/1983 | Milleron | 415/206 |
| 4,547,126 | 10/1985 | Jackson . | |
| 4,746,271 | 5/1988 | Wright . | |
| 4,902,196 | 2/1990 | Byrd | 415/90 |

FOREIGN PATENT DOCUMENTS

| | | | |
|---|---|---|---|
| 1185025 | 7/1959 | France | 416/240 |

*Primary Examiner*—Edward K. Look
*Assistant Examiner*—Mark Sgantzos
*Attorney, Agent, or Firm*—Jones, Day, Reavis & Pogue

[57] ABSTRACT

A fan for a vacuum cleaner has a fan housing, motor and impeller. The fan housing has an inlet and outlet. The impeller has a one piece hub and multiple flexible blades. This flexible blade fan provides better air performance, less noise, better durability, and easier impeller installation than conventional vacuum cleaner fans.

20 Claims, 4 Drawing Sheets

FLEXIBLE IMPELLER WITH ONE-PIECE HUB

This application is a continuation-in-part application Ser. No. 08/495,362 filed on Jun. 28, 1995.

BACKGROUND OF THE INVENTION

The present invention relates to the field of vacuum cleaner fans. In a conventional vacuum cleaner, a fan drives dirt-laden air into a filter bag. There are two common vacuum cleaner configurations. In a "dirty-air" type vacuum cleaner, the fan is positioned before the filter bag and pushes dirt-laden air into the filter bag. In a "clean air" type vacuum cleaner, the fan is positioned after the filter bag and sucks clean air out of the filter bag, drawing the dirt-laden air into the bag.

FIG. 1 shows a conventional dirty-air vacuum cleaner 10. A fan 12 draws air through a floor nozzle 14 to a filter bag 16 by way of a fill tube 18. Dirt removed from the floor by the airflow is thus filtered out and deposited into the filter bag 16. FIG. 2 is a front sectional view of the fan 12, illustrating its principle of operation. A motor 20 is connected to the back of housing 22 and rotates the impeller 24 with a shaft 26. The resulting centrifugal force draws air into an inlet 28 and propels the air outwardly through an outlet 30.

FIG. 3A shows a detailed perspective view of the impeller 24, which is representative of the type of impeller commonly used in dirty-air vacuum cleaners. A conventional impeller 24 comprises a hub 42 supporting a backplate 44 which supports multiple blades 46. The hub 42 has a bore 48 for mounting onto the motor shaft 26. The empty area between the hub 42 and the blades 46 is called the "eye" 49 and is used to provide more space for air entering the inlet 28. The backplate 44 is curved, as shown in FIG. 3B, to reduce the right angle turn encountered by the airflow when it first hits the fan. Also, the blades 46 are typically not aligned radially, but are backswept relative to the rotational direction. Blades 46 are usually curved, as shown in FIG. 3A. The above-indicated design features are incorporated into the impeller design to improve air performance (in terms of suction and airflow) and also reduce fan noise. However, such conventional impellers also suffer from certain drawbacks.

A typical vacuum cleaner impeller is made of rigid material, such as aluminum or polycarbonate. Being rigid, such impellers are prone to damage from fast rotation. In order to establish the airflow required for removing dirt, an impeller must be rotated at high speed, typically 10,000–20,000 RPM. The strong centrifugal force acting on the impeller's mass stresses the curved backplate to pull away from the blades. This centrifugal force also stresses the blade curvature to radially straighten out and causes the backswept blades to tip over toward the backplate. The repeated on-off application of these stresses can produce stress cracks in the backplate and weaken the joint between blade and backplate. These stresses also gradually deform the blade shape and fatigue the impeller material. This damage reduces air performance and the durability of the impeller and increases noise level.

Besides centrifugal damage, there is also shrapnel damage. The impeller can be cracked when hard objects such as stones and bolts are picked up by the vacuum cleaner and hit the impeller with a violent impact. Due to the fast RPM, the imbalance caused by even slight cracks produces excessive vibration, noise, and bearing wear.

Another problem with conventional fans is their RPM limit. Fan size could be reduced without decreasing air performance by increasing the rotational speed. However, a conventional impeller cannot withstand the centrifugal force beyond a certain RPM limit.

In order to increase durability from shrapnel and stress cracking, conventional plastic impellers are reinforced by thickening the backplate and blades. But this solution is inefficient, since the additional mass further increases centrifugal stress, additionally increases manufacturing cost, and reduces the volume available for airflow.

In a conventional vacuum cleaner fan, the impeller diameter is larger than the inlet diameter. Since it will not fit through the inlet, installing or replacing the impeller requires dismantling the fan housing. This typically requires professional servicing, entailing expense and inconvenience due to unavailability of the vacuum cleaner.

BRIEF SUMMARY OF THE INVENTION

In view of the aforementioned drawbacks with conventional vacuum cleaner impellers, there is a need for an impeller with reduced mass and size.

There is also a need for an impeller with improved air performance using a smaller blade size.

There is also a need for an impeller with reduced operating noise.

There is also a need for an impeller with improved centrifugal stress durability.

There is also a need for an impeller with improved shrapnel durability.

There is also a need for an impeller with a higher RPM limit.

There is also a need for an impeller which offers easier installation.

The above needs are satisfied by the present invention in which a vacuum cleaner fan includes a flexible impeller comprising a plurality of pliable blades attached to a hub. The present impeller is received within a fan housing and mounted to the shaft of a fan motor so as to draw air inward through the inlet of the fan housing and propel the air outward through the outlet of the fan housing.

The above and other needs which are satisfied by the present invention will become apparent from consideration of the following detailed description of the invention as is particularly illustrated in the accompanying drawings.

DETAILED DESCRIPTION OF THE DRAWINGS

FIGS. 4A, 4B, 4C, 4D and 4E, respectively illustrate a perspective view, an exploded view and a cross-sectional view of the impeller construction according to a first embodiment of the present invention.

Figure 5A:
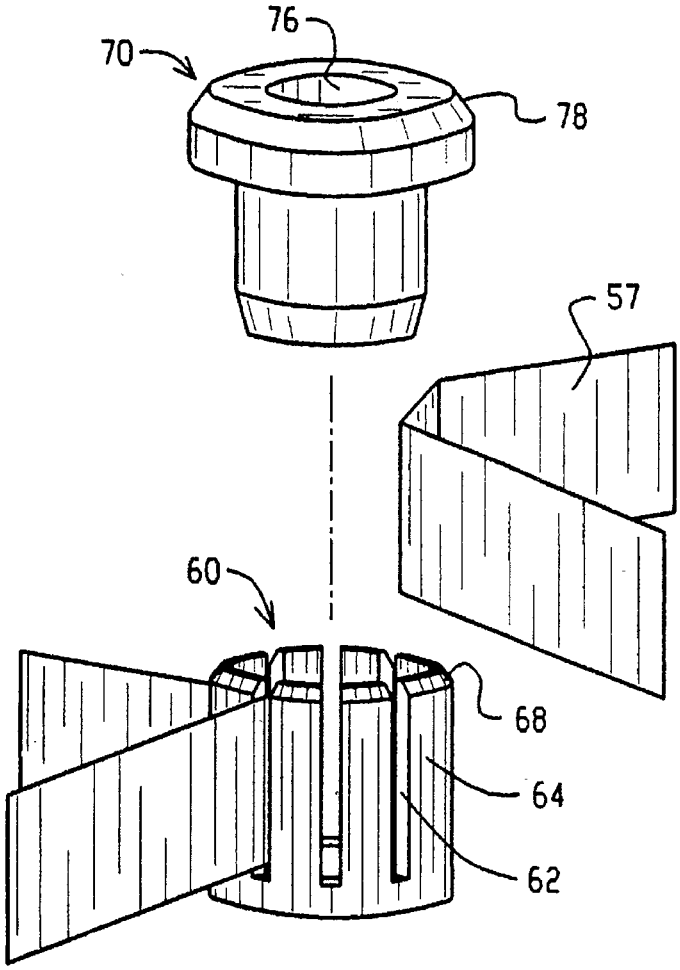
Figure 5B:
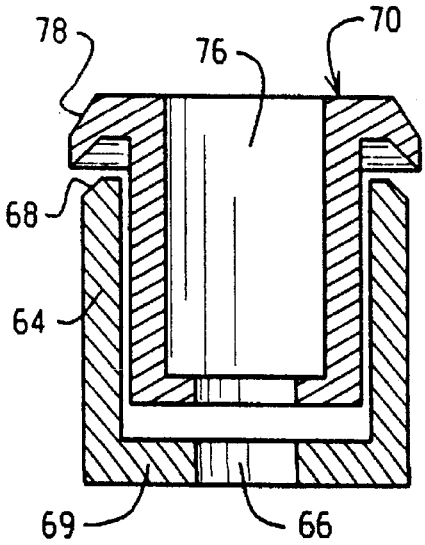

FIGS. 5A and 5B illustrate, in perspective view and phantom view, respectively, a second embodiment of the impeller construction according to the present invention.

Figure 6A:
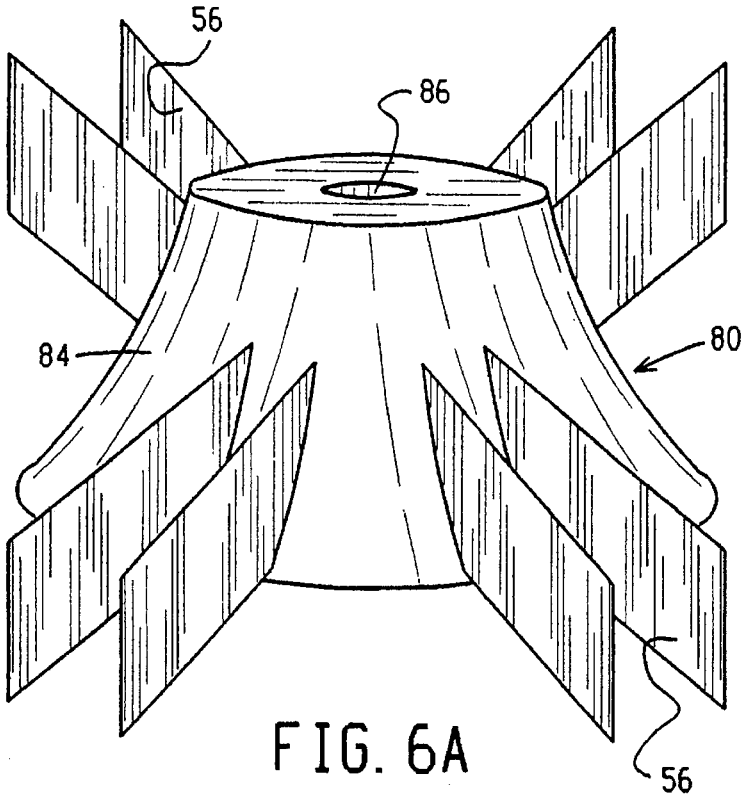
Figure 6B:
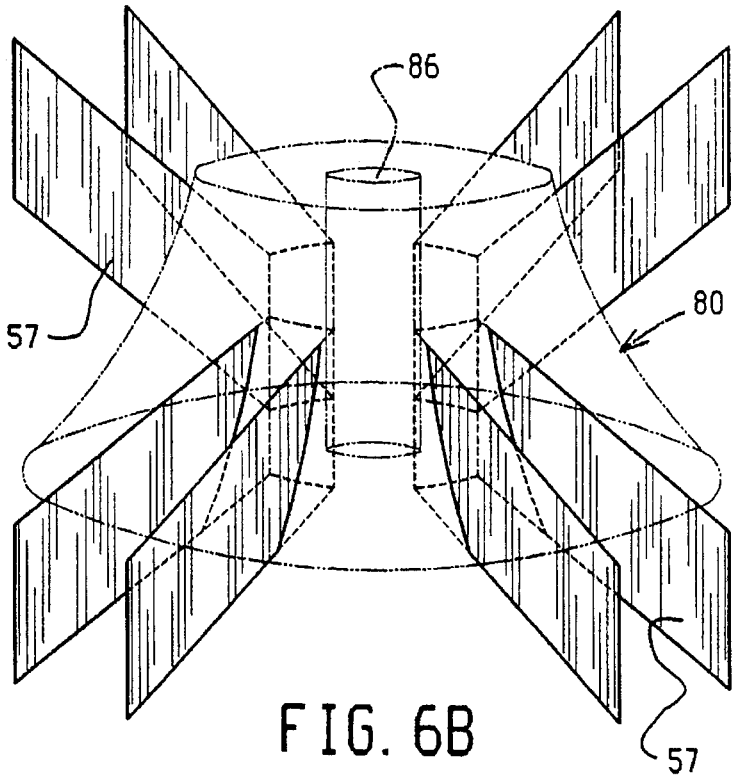

FIGS. 6A and 6B illustrate, in perspective and bottom view, respectively, a third embodiment of the impeller construction according to the present invention.

DETAILED DESCRIPTION OF THE INVENTION

Figure 1:
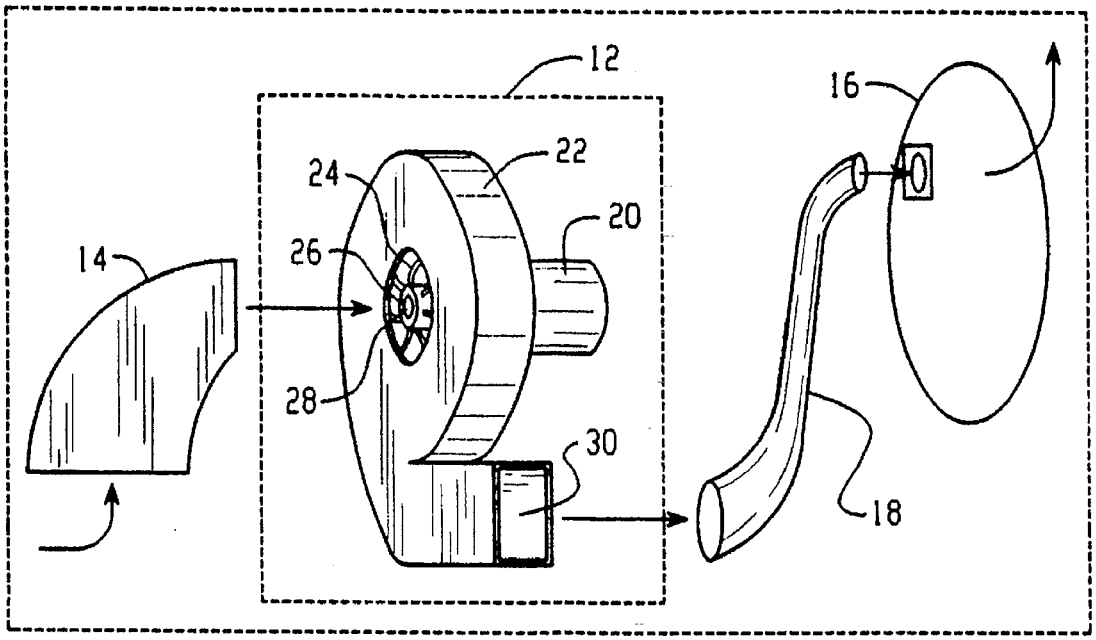
FIG. 1 (PRIOR ART)
FIG. 1 is a schematic view of a conventional dirty-air type vacuum cleaner assembly.
Figure 2:
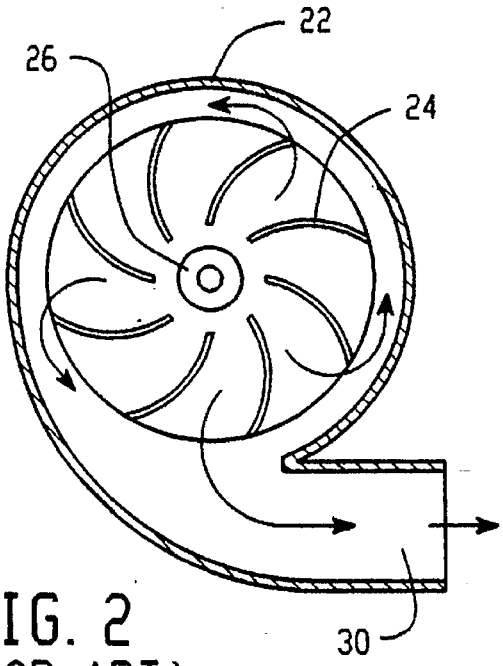
FIG. 2 (PRIOR ART)
FIG. 2 is a front sectional view illustrating the principle of operation of a conventional tangential-flow fan.
Figure 3A:
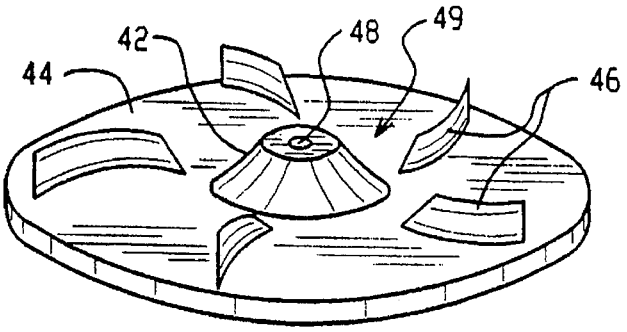
FIG. 3A (PRIOR ART)
FIGS. 3A and 3B are respectively perspective and side sectional views illustrating a conventional impeller.
Figure 3B:
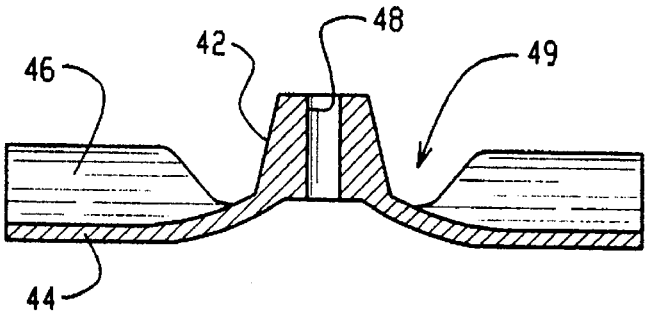
FIG. 3B (PRIOR ART)
Figure 4A:
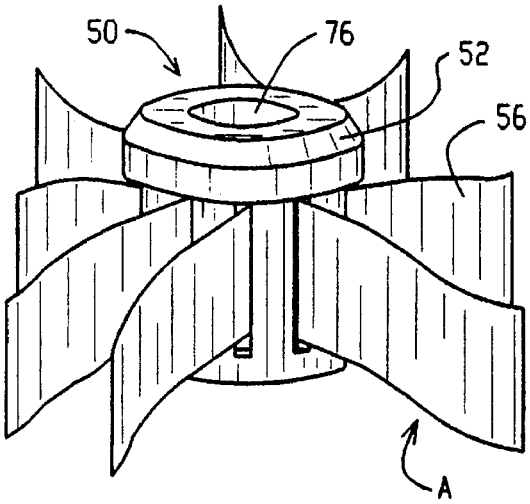

FIG. 4A shows a perspective view of the preferred embodiment of the present invention. A flexible impeller 50 is made to include a plurality of pliable blades 56 which are attached to a hub 52. The present impeller 50 preferably includes 10–14 pliable blades. The hub 52 has a central bore 76 for mounting on a conventional motor shaft 26. When not rotating, the pliable blades 56 hang limply. But, when rotating at common fan motor speeds, about 10,000–20,000 RPM, the pliable blades 56 extend radially outward by centrifugal force and operate as a conventional fan impeller, drawing air from the inlet to the outlet.

With the present invention, blades 56 are made of a thin, pliable material having low mechanical rigidity. In the preferred embodiment, the blades are sufficiently pliable so that the free end of the blade (i.e. the end furthest from the hub) can be bent around to touch the hub. Such thin, pliable blades provide an impeller that is less susceptible to imbalance. In the preferred embodiment, the blades are typically 0.1–2.0 inches wide, 1–5 inches long, and 10–60 mils thick, and the hub is typically about 1 inch high and 0.71 inches in diameter, which has been found to provide good air performance for a typical tangential flow fan operating at 13,000 RPM. Many blade materials have been found to provide good air performance, including metal foil, Mylar film, and synthetic fabrics such as polyester. These fabrics can optionally be coated with a polymer such as urethane in order to improve shrapnel resistance. Though pliable, the blade must be sufficiently unstretchable, at least in the radial direction of the impeller, such that it will not expand when spinning. Thus, stretchable materials such as neoprene can be used, but require an internal fabric, e.g. polyester or Kevlar®, as a reinforcement to limit their stretchability.

The blade can have many shapes. The preferred embodiment in FIG. 4A has a rectangular shaped blade (designated A). The blade can also have a shaped edge, for example, a rounded end (B in FIG. 4A) or also a slanted edge (C) to reduce noise. The blade can also be shredded (D), or can be comprised of multiple strands like a mop (E). The mop design (E) may be comprised of 10–16 polyester monofilaments, each typically 1 mm in diameter, affixed to the hub side by side. Other designs are also possible. When spinning, each of these embodiments (A–E) extend radially straight outward and provide good air performance. Blades comprised of strips or strands (as in D and E) operate more quietly than their unstranded counterparts, and can offer better shrapnel durability by enabling shrapnel to pass through.

Figure 4B:
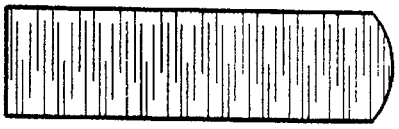
Figure 4D:
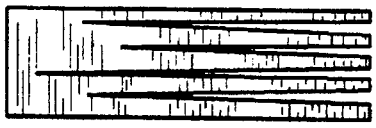
Figure 4C:
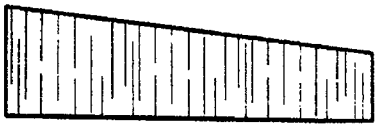
Figure 4E:
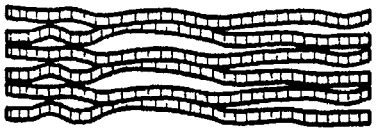

One embodiment of the hub 52 is shown in FIGS. 4B and 4C, shown in an exploded view and a cutaway view, respectively. The impeller 50 comprises a hub 52 and blades 56. The hub 56 comprises a hub case 60 and a hub insert 70, each made of a rigid material, preferably aluminum or plastic. Hub case 60 is cup shaped, with an inner diameter of preferably 10–30 mm and a wall thickness of preferably 2–10 mm. There are an even number of slits 62 extending axially from the top rim 68 substantially down to the floor 69, evenly spaced radially around the circumference of the hub case 60. The material between the slits 62 forms prongs 64. The hub case 60 has an axial bore 66 at the center of its bottom with a diameter matching that of the shaft 26. Its top rim 68 is beveled. The hub insert 70 has a bore 76 running axially through its entire vertical length, and having a beveled overhang 78.

The blades 56 are fashioned from flexible straps 57. To assemble the impeller, each strap 57 is folded at its center and placed around adjacent prongs 64. Hence, each strap 57 yields two blades 56. The hub insert 70 is then inserted into the hub case 60. The strap 57 is pinched between the hub case 60 and the hub insert 70, which keeps it from slipping out. The beveled overhang 78 mates with the beveled top rim 68 to keep the prongs 64 from bending outward from centrifugal force.

FIGS. 5A and 5B, respectively, show a perspective view and a phantom view of a hub 80 according to a second embodiment of the invention. The top and bottom surfaces of the hub 80 are parallel. The sides can be vertically straight, rendering it cylinder shaped. The sides can also be slantedly straight, rendering it rubber stopper shaped. The sides can also be parabolic (as shown in FIGS. 5A and 5B). The hub 80 is overmolded around multiple flexible straps 57 that are bent at their center. Each strap 57 forms two blades 56 which intersect the peripheral wall 84 of the hub 80 at evenly spaced locations. During operation, the plane of each blade is coplanar with the axis of the hub 80.

The plastic hub material substantially surrounds the straps 57 in the vicinity of their fold. This yields a reliable mechanical bond between the hub material and the straps 57. Additionally, the strap material and hub material can be selected to provide a chemical bond. For example, the hub 80 can be formed of urethane and the straps 57 can be formed of a urethane-coated polyester in order to form a polymer bond. The hub 80 is typically molded from a plastic such as polycarbonate or urethane. The plastic can be either rigid or flexible.

A flexible hub according to the present invention is practical only with pliable blades because of their light weight. The heavier mass of conventional blades would deform a flexible hub when spinning and throw it off balance. The flexible hub 80 preferably has a durometer of 60A–90D. This offers several advantages. The flexible hub enables a snug fit around the shaft while reducing the possibility of the hub "jamming" or "freezing" onto the shaft. The flexible hub is more impact resistant. Due to its flexibility, this flexible hub reduces the possibility of the blade shearing at the edge where it intersects the hub, in the event that the blade is pulled by shrapnel. Also, if the blade is yanked by shrapnel, the present flexible hub reduces tensile tearing of the blade by providing strain relief.

Alternatively, the hub 80 need not be completely flexible. A hub may be fashioned so that only the material surrounding the bore is flexible. Such a hub would preserve the benefit of alleviating hub "jamming" onto the shaft. The hub may be made of flexible material surrounding a rigid tube, preferably metal, which defines the bore. A hub of this type would be impact resistant and would protect the blades from shearing and tensile tearing.

It has been observed that the present flexible fan offers several desirable performance features: When rotating at common fan motor speeds (10,000–20,000 RPM), the flexible blades 56 extend rigidly radially outward by centrifugal force and operate as a conventional fan impeller, drawing air from the inlet to the outlet. Increasing either the fan length or width increases air performance (suction and airflow). The present flexible impeller has smaller blade area (length times width) than a corresponding conventional rigid impeller with same air performance. The present flexible impeller emits less noise than a conventional impeller with same air performance. Blade thickness has little effect on air performance, as observed with blades from 2 mils to 60 mils in thickness. Blades made of even Scotch® tape have produced over 30 inches water suction (over 2 psi) and a powerful wide-open airflow of 160 CFM, although admittedly shrapnel durability was poor.

A third embodiment of the hub is shown in FIGS. 6A and 6B. The hub 90 is formed of only one piece, and is made of a rigid material, preferably plastic or aluminum. The hub 90 is preferably substantially cylindrical with a main hub body 92 formed with a hub base 94 and a central bore 96 for mounting onto a conventional motor shaft 26. The top and bottom surfaces of the hub 90 are preferably normal to the bore 96.

A plurality of identical prongs 98 are connected to the hub base 94 and are evenly spaced around the periphery of the hub 90. The prongs 98 are preferably at least as long as the width of the straps 57. Each prong 98 extends in an axial direction from the hub base 94 and is substantially parallel with the bore 96. Each prong 98 is separated from the main hub body 92 by a channel 100.

Each channel 100 is generally U-shaped, opening to the hub periphery at two mouths or openings 102. The width of each channel 100 (i.e. the distance between the channel walls) is uniform throughout the channel 100, and the walls of each channel are parallel with the bore 96.

The regions on the main hub body 92 between the channels 100 define ribs 104. These ribs 104 have outward features resembling the prongs 98 so as to provide a uniform external appearance. The exterior surfaces of the prongs 98 are preferably substantially flush with the exterior surfaces of the ribs 104, thus providing a substantially cylindrical periphery for the hub 90.

To assemble the impeller, as according to this embodiment, each pliable strap 57 is inserted at its respective center through a channel 100 and around a prong 98. Hence, each strap 57 yields two blades. The width of the channel 100 approximately equals the strap thickness, so that a tight frictional fit between the prong 98 and the main hub body 92 prevents the strap 57 from slipping out. All corners connecting the straps 57, such as at the mouth 102, should preferably be rounded to prevent damage to the straps.

Glue is applied to the straps 57 or channels 100 to both reduce friction upon insertion (since the glue acts as a lubricant when wet) and to prevent strap slippage when the glue has dried. Another method of preventing strap slippage is by applying beads of glue 106 or sealant to each mouth 102, which mechanically prevents the strap 57 from slipping out.

Yet another method of preventing strap slippage is by coating the straps 57 with a thermoplastic coating such as polyurethane and heating the hub 90 after the straps 57 are inserted in order to melt the thermoplastic. An adhesive bond then forms between the strap 57 and the walls of the channel 100. If the channel 100 is tight enough, the melted thermoplastic oozes out of the mouth 102, forming beads 106 at the mouth 102 that mechanically prevent the strap 57 from slipping out.

In order to prevent the prongs 98 from being bent outward by centrifugal force, the prongs 98 can extend beyond the strap 57 and be held in place by a retaining ring 108.

The present flexible impeller offers an improvement in air performance and noise levels over conventional impellers despite eliminating several typical design features, including the eye, the backplate curve, the blade angle and the blade curve. Since such features are routinely engineered into conventional impellers to optimize air performance and reduce noise, the observed improved performance is surprising. It is suspected that the thinness and lack of a backplate as according to the present invention leaves greater room for airflow and reduces air drag around the blades.

As shown hereinabove, the present flexible impeller solves the drawbacks of conventional impellers. The present flexible blade impeller also uses less material since it lacks a backplate and the blades are smaller than a conventional impeller. This reduces manufacturing and handling costs. Since the blades are flexible, they are not susceptible to deformation and stress cracks from centrifugal force, nor do they become fatigued from repeated on-off cycles. They are also less susceptible to impact breakage, since they bend instead of cracking when impacted, and also since they present a smaller target for shrapnel (due to smaller blades and no backplate). Since the present blades are much thinner and lighter than those of a rigid blade fan, centrifugal stress is much smaller. Furthermore, the small centrifugal force is uniform along the blade width and tensile in direction. The present flexible impeller can therefore withstand many times higher RPM than a conventional impeller having similar air performance, because with conventional impellers, the backplate and curved blades render the centrifugal stress highly nonuniform and flexural in direction. Hence, the present flexible fan has a considerably higher RPM limit.

With a conventional fan, even minor blade asymmetry (due to manufacturing or blade damage) yields serious impeller imbalance, causing excessive vibration, noise, and bearing wear. In contrast, since the present flexible blades can be made much lighter than rigid blades, blade asymmetry causes negligible impeller imbalance. For example, the shortening of one blade of a conventional impeller by 1 mm will cause severe imbalance problems. No such imbalance is observed with the present flexible impeller.

In addition to the above, if the hub is sufficiently small and the blade material sufficiently flexible, the present flexible impeller can be installed right through the fan's inlet, without dismantling the fan housing. In this way, the fan can be replaced without requiring professional service, reducing expense and inconvenience due to the unavailability of the vacuum cleaner.

Although the preferred embodiment was illustrated for a dirty-air vacuum cleaner, the present invention could alternatively be used with a clean-air vacuum cleaner. Although the impeller of the preferred embodiment was illustrated for a tangential flow fan, it can equally be applied in a centrifugal axial flow fan.

The foregoing description of the preferred embodiment has been presented for purposes of illustration and description. It is not intended to be limiting insofar as to exclude other modifications and variations such as would occur to those skilled in the art. Any modifications such as would occur to those skilled in the art in view of the above teachings are contemplated as being within the scope of the invention as defined by the appended claims.

What is Claimed:

1. A fan impeller comprising:

a plurality of pliable blades for centrifugally displacing a volume of air upon rotation of the impeller; and a hub for retaining said plurality of blades, wherein said hub secures the impeller to a motor-driven shaft for producing rotation, and wherein the hub further comprises:

a main hub body formed with a hub base; and a plurality of prongs which extend in an axial direction from the hub base to define a plurality of respective channels between the prongs and the main hub body, wherein the respective blades are received and retained by the channels, wherein the main hub body includes ribs between the respective prongs so that the respective channels are generally U-shaped.

2. The fan impeller of claim 1 wherein each blade has a shaped edge.

3. The fan impeller of claim 1 wherein each blade is formed of a flat piece of material which is shredded.

4. The fan impeller of claim 1 wherein each blade is comprised of multiple strands.

5. The fan impeller of claim 1 wherein the blades are between 1–5 inches long, and between 0.10–2.0 inches wide.

6. The fan impeller of claim 1 wherein the blade material comprises a synthetic fabric.

7. The fan impeller of claim 6 wherein the synthetic fabric is polyester and is coated with a polymer.

8. The fan impeller of claim 1 wherein the blades are formed from a plurality of straps, wherein each strap is folded at the center to provide a pair of blades, and wherein each strap is looped around a respective prong.

9. The fan impeller of claim 1 wherein the prongs and ribs have exterior surfaces which are substantially flush, thus providing a substantially cylindrical periphery for the hub.

10. The fan impeller of claim 1 wherein glue is applied between the respective blades and channels to prevent blade slippage.

11. The fan impeller of claim 1 wherein the respective channels open to the hub periphery at respective mouths wherein a bead of glue is applied to each mouth to mechanically prevent the respective blade from slipping out.

12. The fan impeller of claim 1 wherein the respective blades are coated with a thermoplastic coating, wherein the coating is melted to mechanically prevent the blades from slipping out.

13. The fan propeller of claim 1 wherein each blade is frictionally retained between its respective prong and the main hub body.

14. The fan impeller of claim 1 wherein the prongs are held in place by a retainer ring.

15. A fan impeller comprising:

a plurality of pliable blades for centrifugally displacing a volume of air upon rotation of the impeller; and a hub for retaining said plurality of blades, wherein said hub secures the impeller to a motor-driven shaft for producing rotation, and wherein the hub further comprises:

a main hub body formed with a hub base; and a plurality of prongs which extend in an axial direction from the hub base to define a plurality of respective channels between the prongs and the main hub body, wherein the respective blades are received and retained by the channels, wherein each blade is frictionally retained between its respective prong and the main hub body.

16. The fan impeller of claim 15 wherein each blade has a shaped edge.

17. The fan impeller of claim 15 wherein the blades are between 1–5 inches long, and between 0.10–2.0 inches wide.

18. The fan impeller of claim 15 wherein the blade material comprises a synthetic fabric.

19. The fan impeller of claim 18 wherein the synthetic fabric is polyester and is coated with a polymer.

20. The fan impeller of claim 15 wherein the blades are formed from a plurality of straps, wherein each strap is folded at the center to provide a pair of blades, and wherein each strap is looped around a respective prong.

* * * * *